US007444919B1

(12) United States Patent
Mansfield

(10) Patent No.: US 7,444,919 B1
(45) Date of Patent: Nov. 4, 2008

(54) TUBULAR LINEAR SYNCHRONOUS MOTOR GUN

(75) Inventor: Francis A. Mansfield, Colonial Beach, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 322 days.

(21) Appl. No.: 11/513,438

(22) Filed: Aug. 29, 2006

(51) Int. Cl.
*F41F 1/00* (2006.01)

(52) U.S. Cl. ..... 89/8

(58) Field of Classification Search ..... 89/8
See application file for complete search history.

(56) References Cited

U.S. PATENT DOCUMENTS

| | | | | |
|---|---|---|---|---|
| 4,924,750 | A | 5/1990 | Neugebauer | |
| 4,928,572 | A | 5/1990 | Scott et al. | |
| 5,076,136 | A | 12/1991 | Aivaliontis et al. | |
| 5,127,308 | A * | 7/1992 | Thompson et al. | 89/8 |
| 5,138,929 | A | 8/1992 | Weldon et al. | |
| 5,168,118 | A * | 12/1992 | Schroeder | 89/8 |
| 5,235,144 | A | 8/1993 | Matsui et al. | |
| 5,431,083 | A | 7/1995 | Vassioukevitch | |
| 5,483,863 | A * | 1/1996 | Dreizin | 89/8 |
| 5,511,488 | A | 4/1996 | Powell et al. | |
| 5,717,261 | A | 2/1998 | Tozoni | |
| 5,722,326 | A | 3/1998 | Post | |
| 6,633,217 | B2 | 10/2003 | Post | |
| 6,816,652 | B1 | 11/2004 | Zeigler | |
| 6,827,022 | B2 | 12/2004 | van den Bergh | |

FOREIGN PATENT DOCUMENTS

| | | |
|---|---|---|
| DE | 38 30 284 | 3/1990 |
| DE | 40 02 786 | 8/1991 |
| DE | 44 22 394 | 1/1998 |
| EP | 0 928 944 | 7/1999 |

* cited by examiner

*Primary Examiner*—Stephen M Johnson
(74) *Attorney, Agent, or Firm*—Gerhard W. Thielman, Esq.

(57) ABSTRACT

An electromagnetic (EM) launcher that receives electrical power is provided for ejecting a projectile. The launcher includes an armature for holding the projectile and a launch conduit for accelerating the armature along a longitudinal direction and thereby ejecting the projectile. The armature includes a Halbach array. The conduit includes a multi-phase linear synchronous motor (LSM) drive and short conducting elements. The Halbach array forms a plurality of concentric rings disposed longitudinally along the armature. Each ring contains a plurality of magnets distributed concentrically. Each magnet in the corresponding ring has a magnetic field oriented with north direction of the magnetic field pointing at one of radially inward, radially outward, longitudinally inward and longitudinally outward.

8 Claims, 5 Drawing Sheets

TUBULAR LINEAR SYNCHRONOUS MOTOR GUN

STATEMENT OF GOVERNMENT INTEREST

The invention described was made in the performance official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to electromagnetic (EM) launchers. In particular, the launcher incorporates a linear synchronous motor (LSM) drive. A projectile is contained within a bucket (serving as an armature) equipped with an annular Halbach array. The array uses magnets disposed parallel to the nozzle with adjacent magnets oriented perpendicular (i.e., $\pi/2$ rotation) to each other in rotating fashion.

Conventional rail guns employ two or more conducting rails within the breech and/or along the barrel to accelerate the armature that pushes the projectile for launch. The conventional technology exhibits deficiencies with rail life, energy storage and transfer, thermal management, and sabot design.

SUMMARY

Various exemplary embodiments of this invention for the LSM drive launcher provide acceleration for a projectile of any type, size, weight, and shape up to 10 km/s and greater in velocity to an altitude exceeding 14 km and a distance of over 20,000 km. Various exemplary embodiments of the launcher provide a viable alternative to conventional methods used today for ship self-defense, missile defense, direct and indirect fire support, force protection, space transport, tactical supply, nuclear waste disposal, space cargo, immediate supply, micro-satellite launch, and medical evacuation. The power for the LSM drive may be provided by a multi-phase electrical power source with a cyclo-converter having variable frequency and variable voltage.

Various exemplary embodiments of the launcher may be used to destroy any target anywhere on or above the earth. For American policy-makers, this may be accomplished from either the continental United States (CONUS) or else international waters. The projectile, launched at hypervelocity speeds, would be extremely difficult to intercept, thereby rendering it virtually unstoppable. Consequently, projectiles may be launched expeditiously and without endangering personnel and assets from retaliatory response. The intended targets could be mobile or fixed-ground, and air assets, including satellites, missiles, and aircraft.

The ability to strike anywhere in the world, within an hour from CONUS or within minutes from international waters, would provide policy-makers flexible capability for target-neutralization. Also, various exemplary embodiments may be used to ballistically deliver acceleration-resistant supplies to beleaguered troops on the ground.

Various exemplary embodiments provide an EM launcher that receives electrical power to eject a projectile. The launcher includes an armature for holding the projectile and a launch conduit for accelerating the armature along a longitudinal direction and thereby ejecting the projectile. The armature includes a Halbach array. The conduit includes a multi-phase LSM drive a plurality of permanent magnets, both distributed longitudinally along the conduit.

The armature and the conduit may form concentric and radially successive tubular cross-sections. The Halbach array forms a plurality of concentric rings disposed longitudinally along the armature. Each ring contains a plurality of magnets distributed concentrically. Each magnet in the corresponding ring has a magnetic field oriented with north direction of the magnetic field pointing at one of radially inward, radially outward, longitudinally inward and longitudinally outward.

In various exemplary embodiments, a method for launching the projectile incorporates procedures for holding the projectile by an armature, providing a Halbach array for the armature, inserting the armature in a launch conduit having a longitudinal direction, providing a multi-phase LSM drive for the launch conduit, providing a plurality of permanent magnets distributed longitudinally along the conduit in cooperation with the LSM drive, and accelerating the armature along the longitudinal direction by supplying alternating electric current through the multi-phase LSM drive.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which.

DETAILED DESCRIPTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

Figure 1:
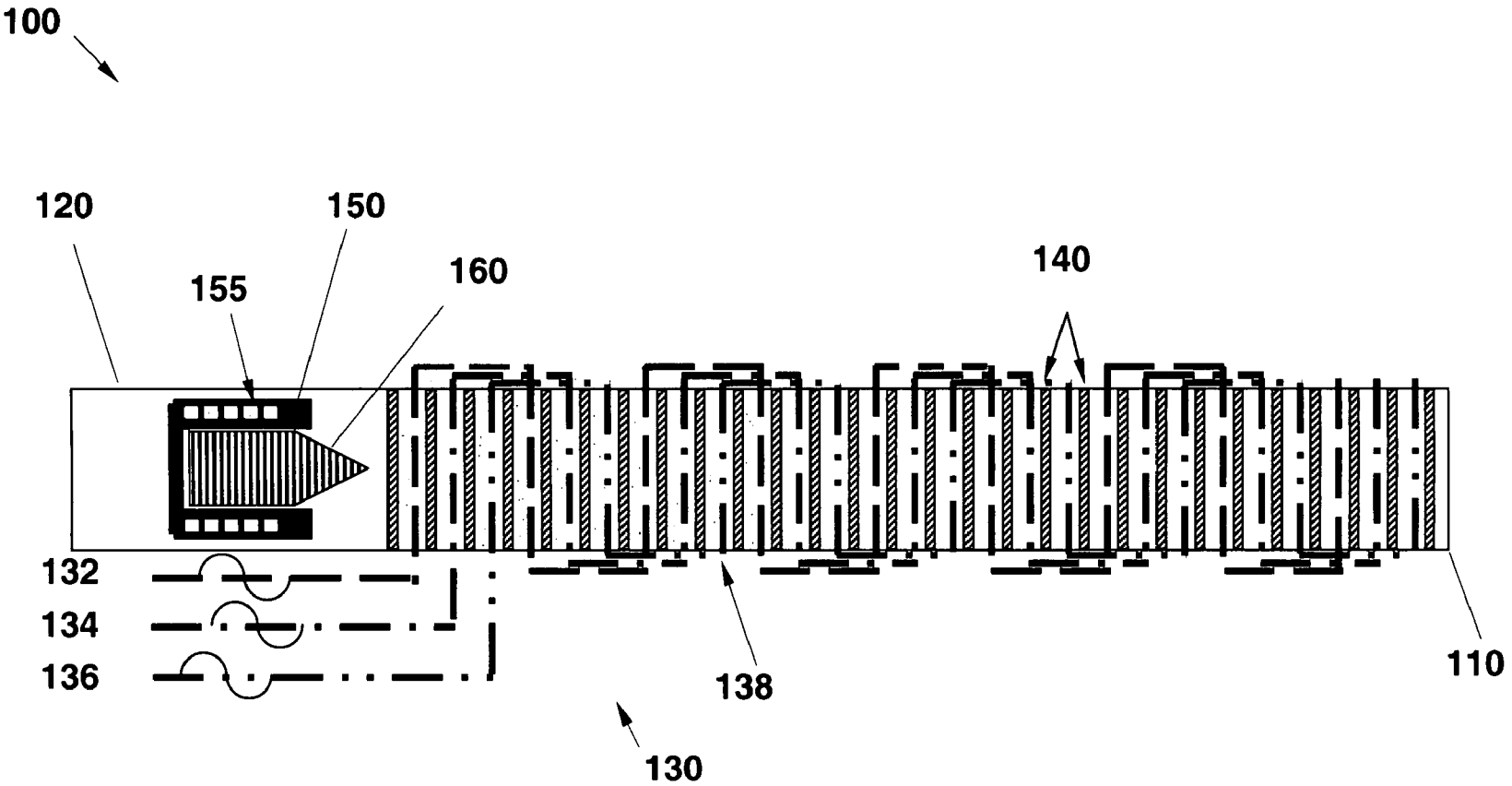
FIG. 1 is an elevation view of an EM launcher with representation of a launch tube and a launch bucket that includes a Halbach array.

FIG. 1 shows an elevation view of an electromagnetic (EM) launcher with a linear synchronous motor (LSM) drive. The EM launcher 100 includes a launch conduit or duct 110 having a breech end 120 and a multi-phase LSM drive 130, showing three phases in this illustration. The launch conduit 110 enables a payload to be ejected therefrom by traveling along its longitudinal direction from the breech end 120.

The LSM drive 130 may include one or more alternating current power sources to supply electric current 132, 134, 136 for first, second and third phases respectively. Alternatively, the drive 130 may employ a greater or lesser number of phases to supply alternating current to the conduit 110. Those of ordinary skill in the art will recognize that the description of a three-phase drive is exemplary only and not limiting with respect to the scope of the invention.

Electric power may be carried by wires 138 that helically envelop or otherwise coil around the launch conduit 110 thereby forming a tubular "track" along which an object may travel. The wires 138 carry the alternating electric current from the sources 132, 136, 138 to create complimentary fluxing magnetic fields as understood by Maxwell's equations. These drawings are conceptual only and are not drawn to scale.

A plurality of induction track elements 140 may be longitudinally distributed along the launch conduit 110 at specified intervals. The induction track, also known as "Inductrack" as developed by Lawrence Livermore National Laboratories for train levitation, obviates the necessity of superconducting coils or stability control circuits employed in other magnetic levitation (i.e., "maglev") systems. Further background may be found in "Maglev: a new approach" by R. F. Post, *Scientific American*, January 2000.

The concentric elements 140 represent shorted conducting material, each formed in a ring configuration around the conduit 110. In response to the moving magnetic field produced by the Halbach array 155, the elements 140 may induce repulsive magnetic fields along the conduit 110 to push against and thereby levitate the object to be translated along.

The breech end 120 may contain an armature or launch bucket 150 having distributed along a Halbach array 155 of annular permanent magnets. The armature 150 may be configured to hold a projectile 160 to be ejected from the launcher 100 at high speed. Upon command, the armature 150 may accelerate within the launch conduit 110 from the breech end 120. Upon reaching a muzzle end of the launch conduit 110, the bucket may be halted, while the projectile 160 continues longitudinal translation for ejection therefrom.

Each of the annular magnets in the Halbach array 155 forms a toroidal ring having a magnetized orientation independent of an adjacent annular magnet. The induction track elements 140 provide self-induced levitation from the Halbach array 155 in the armature 150 by drawing about one watt per pound-force of levitation. Although the induction track elements 140 yield no thrust to the armature 150, this effect provides consistent levitation force, backup levitation in the event of power failure during launch and exponential damping for vibration produced by the drive 130.

The Halbach array is named after Klaus Halbach, retired Lawrence Berkeley National Laboratory physicist. Generally, Halbach arrays employ permanent cross-magnetized magnets disposed longitudinally in an array. This arrangement may concentrate a magnetic field at the forward face of the array, while cancelling the field at its rear face. In addition to enhancing the magnetic field, the field's longitudinal and transverse components may be substantially sinusoidal in their spatial variation with negligible high-frequency harmonics. The Halbach array 155 is described in further detail below.

Figure 2A:
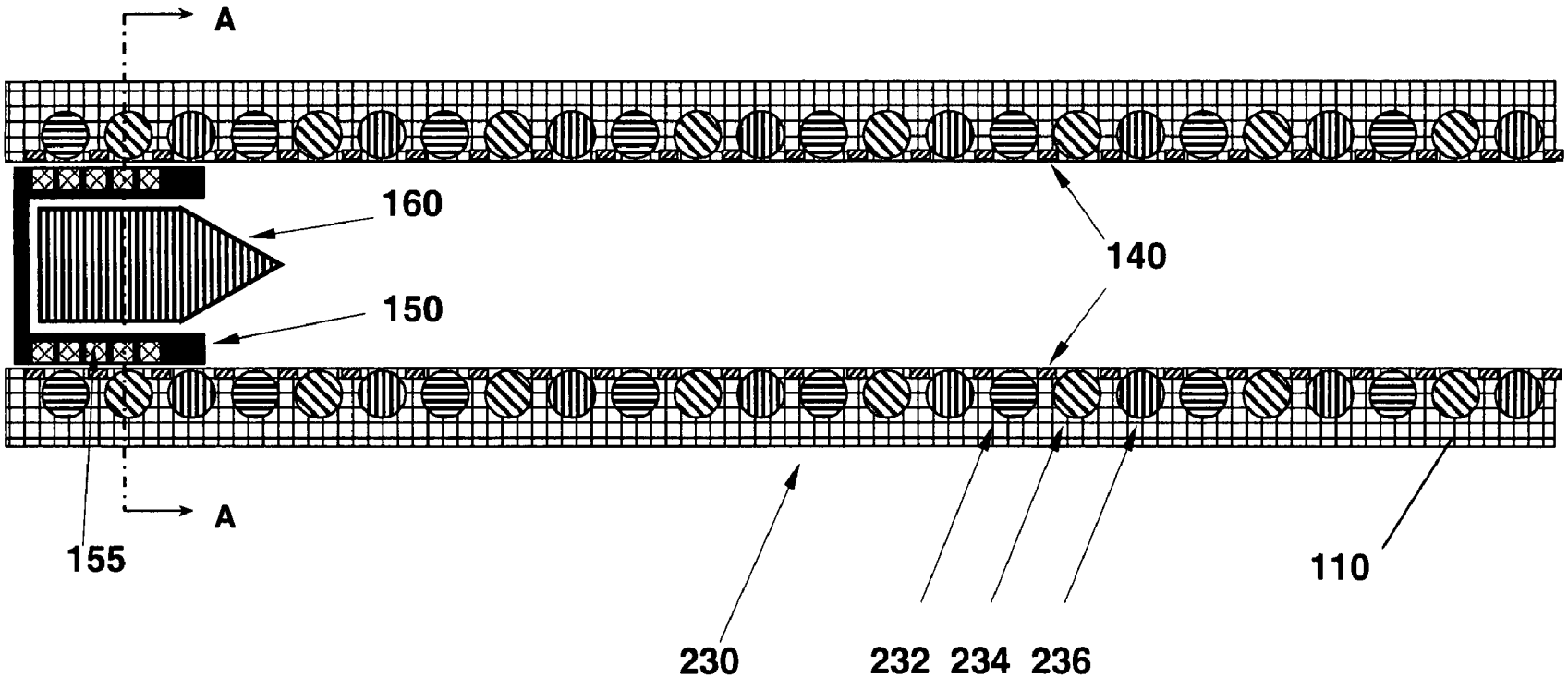
FIG. 2A is an elevation view of the launch tube with an Inductrack and power supply wires.

FIG. 2A shows an elevation view of the launch conduit 110 with the armature 150 therein containing the projectile 160. Power supply wires 230 (representing the wires 138 for the drive 130 in FIG. 1) may include three or more separate carriers 232, 234, 236 shown in cross-section enveloping and within the launch conduit 110. The wires 230 may be disposed between the inductor track elements 140.

Figure 2B:
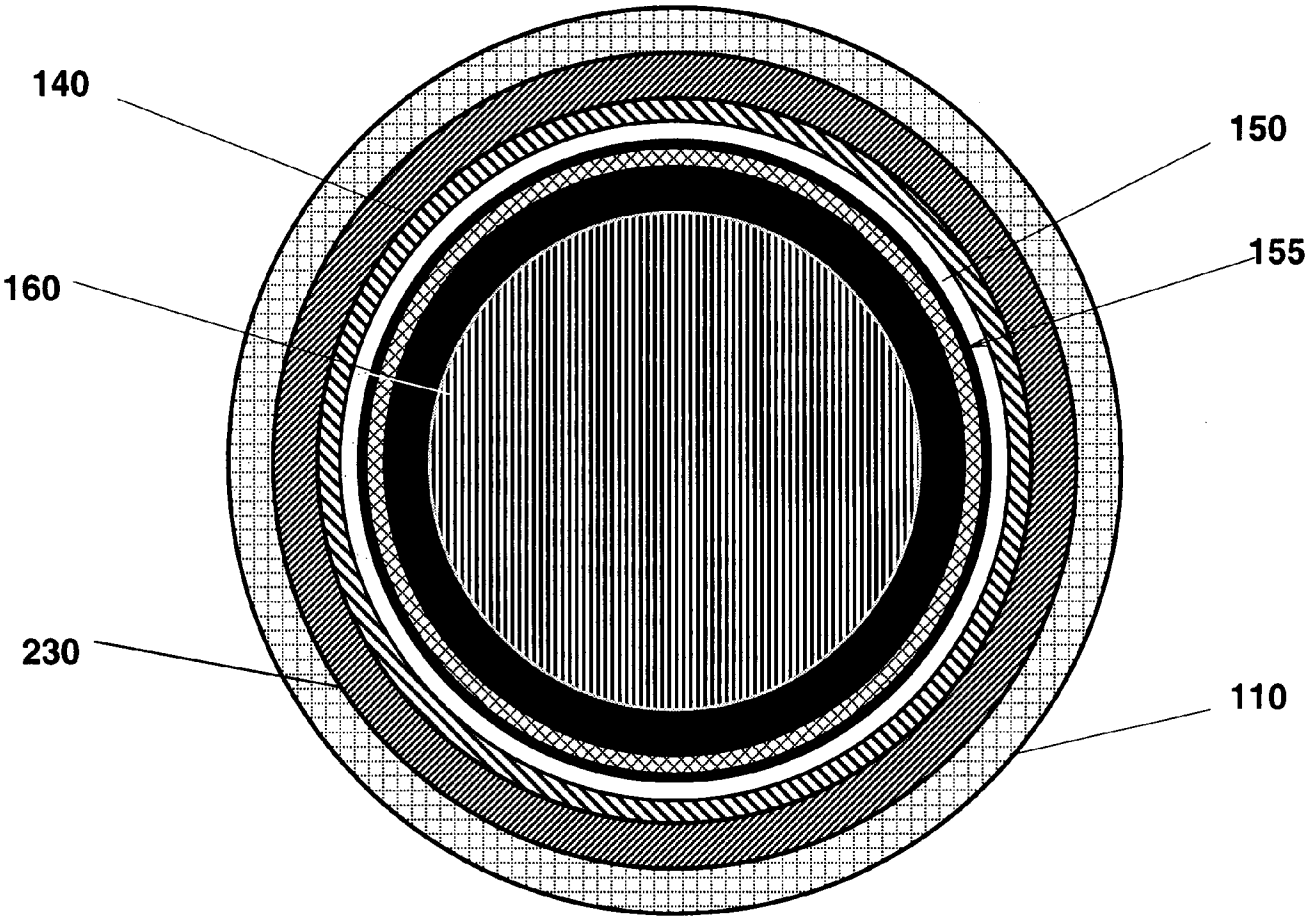
FIG. 2B is a cross-section view of the launch tube.

FIG. 2B shows a cross-section view of the launch conduit 110 containing the wires 230 and the annular shorted conducting elements 140 corresponding to line A-A in FIG. 2A. The Halbach magnets 155 may be circumferentially distributed around the armature 150 in the configuration shown. The armature 150 may be contained within the launch conduit 110 and holding the projectile 160.

In the configuration depicted by the drawings, the projectile 160, armature 150 and conduit 110 project successive radially enveloping concentric and co-axial cylindrical profiles such that the armature 150 and the conduit 110 represent tubular cross-sections. Those of ordinary skill will recognize that the axi-symmetric components depicted therein, including the launch conduit 110, the armature 150, the projectile 160 and related items are exemplary only and may alternatively be designed to incorporate non-circular cross-sections. For example, the Halbach array may be replaced with a conductive sleeve thereby creating a Linear Induction Motor version of the armature.

Figure 3:
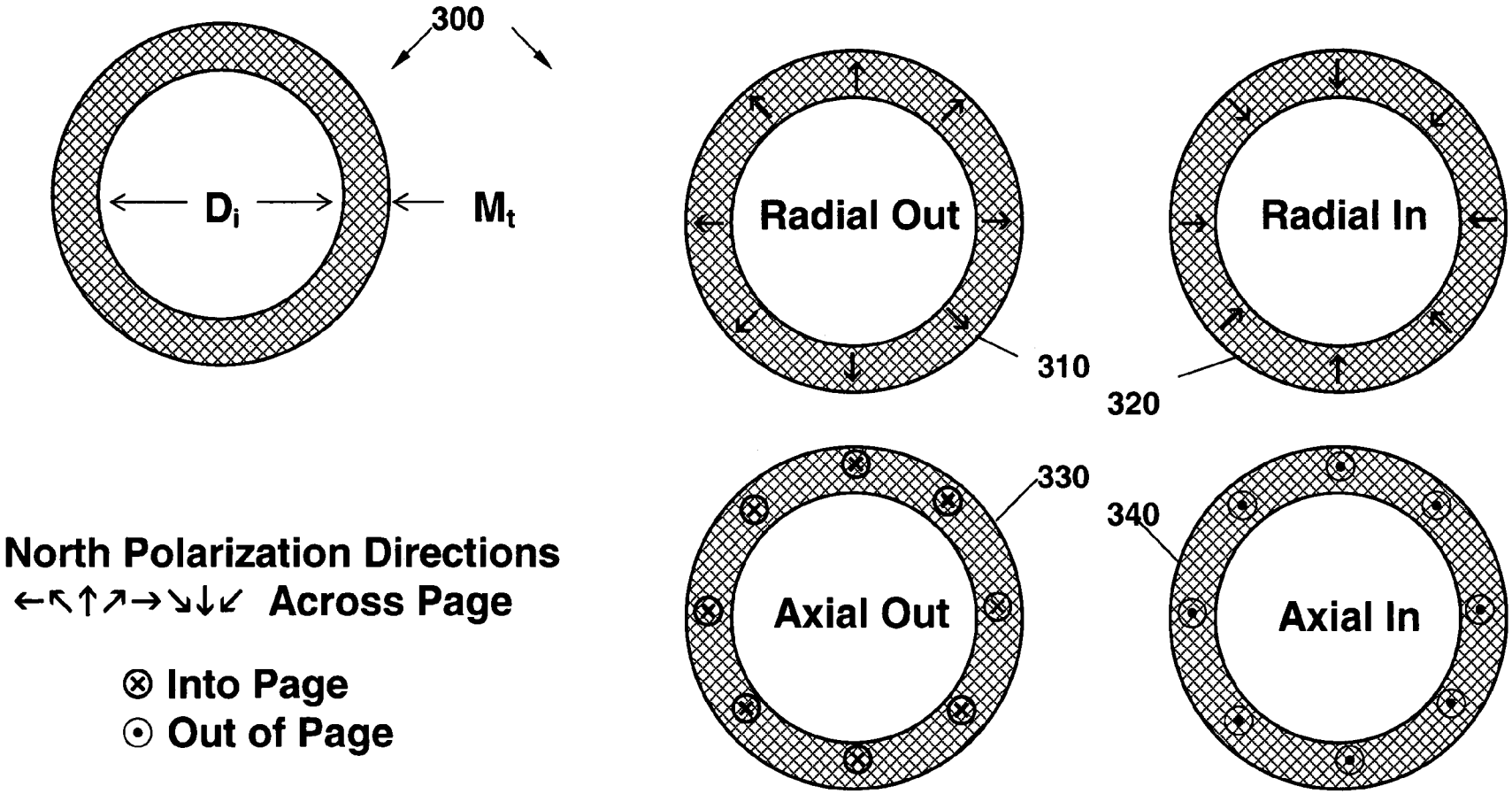
FIG. 3 is an cross-section view of a ring magnet in the Halbach array.

FIG. 3 shows a cross-section view of individual Halbach array magnets 300 as observed from the breech end 120 of the launch conduit 110. The annular magnet has an inner diameter $D_i$ and a thickness $M_t$, both contained within cylindrical walls of the armature 150, for example.

Field orientation of the annular magnets 300 may correspond to north pointing radially outward for magnet 310, radially inward for magnet 320, axially outward 330 and axially inward 340. A legend symbolically identifies each projection to the north direction across the page in $\pi/4$ (or 45°) increments and into (axially out) and out of (axially in) the drawing. The orientations for magnets 310, 320, 330, 340 represent orthogonal north directions for emanation of their respective magnetic fields, which can be described by perpendicular rotation shifts of $\pi/2$ (or 90°) with respect to each adjacent magnet.

Figure 4:
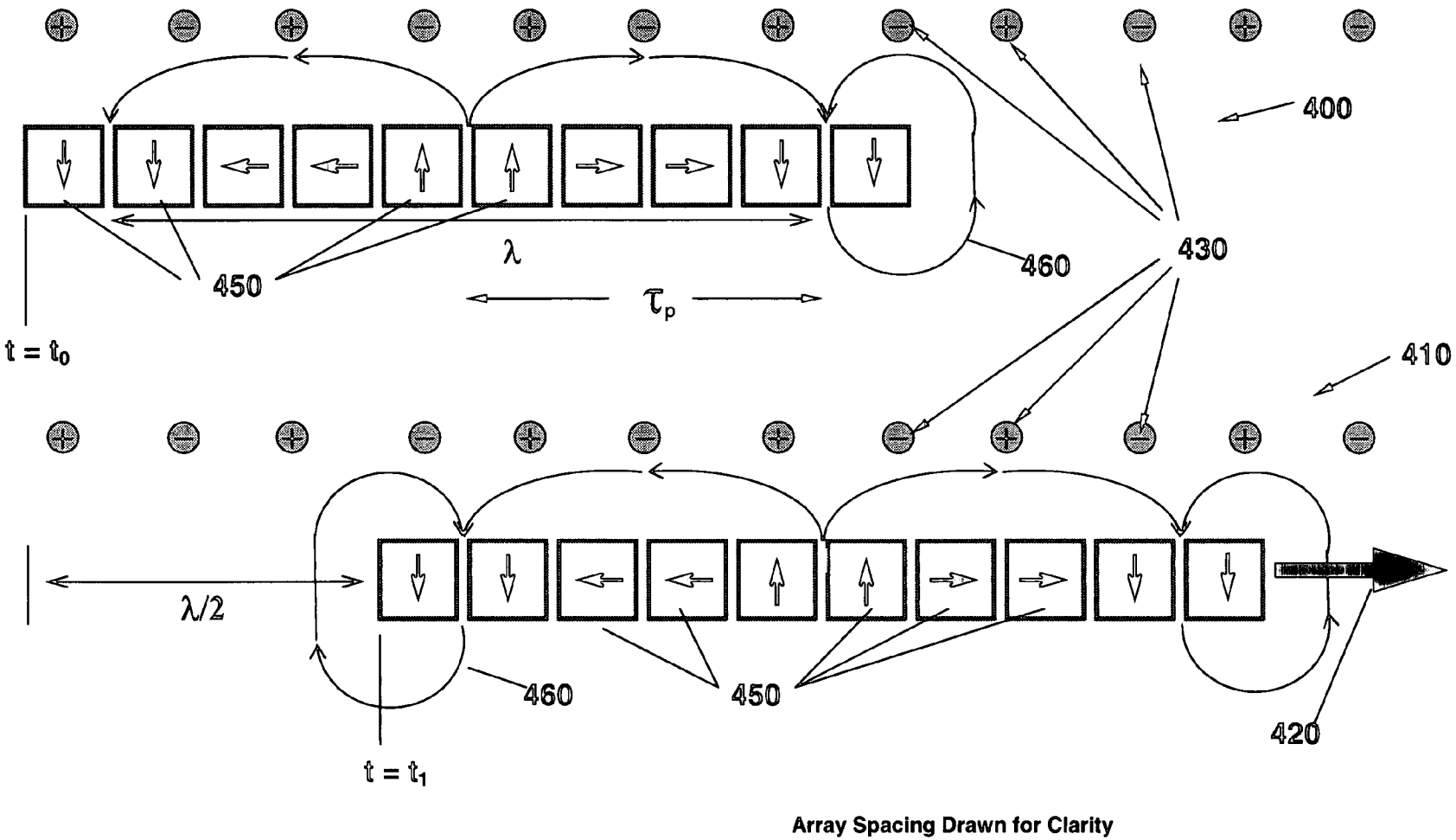
FIG. 4 is a simplified elevation view of the power supply wires in conjunction with the Halbach array.

FIG. 4 illustrates a representational elevation view of select components of the launcher 100 with the armature 150 being stationary 400 and in motion 410 along the launch conduit 110 at a velocity 420. In particular, the multi-phase power provision may be represented by wires 430 that depict electric current flow in the positive or negative directions as symbolically identified.

A double-Halbach array 450 is shown both at time $t_0$ being stationary 400 and time $t_1$ for the bucket in motion 410. The array 450 includes pairs of magnets oriented together along the armature 150. Each magnet may be oriented north as depicted by the arrow shown. The double-Halbach array 450 includes doublet-pairs of magnets, both magnets in each pair having the same field orientation, and each pair having field orientation orthogonal to the adjacent pair.

The array 450 may produce a magnetic field 460 shown by lines of uniform magnetic flux density across an array field length $\lambda$. The armature 150 carrying the projectile 160 travels along the conduit 110 a distance of half the array field length or $\lambda/2$ in the time interval $t_1$-$t_0$. These descriptions are presented for informational purposes only. The accompanying diagrams in FIG. 4 are not drawn to scale, particularly the positioning of the magnets relative to the coils.

Various exemplary embodiments employ a straight launch tube to shoot a hypersonic projectile to a target on or above the earth using self-induced magnetic levitation and a permanent magnetic-based tubular LSM drive. A system encompassing these embodiments may include seven portions: a) energy generation, b) power conversion, c) energy storage, d) launch tube, e) LSM/LIM drive, f) launch bucket, and g) hypersonic projectile. A procedure for providing acceleration to the projectile may also be envisioned as incorporating these capabilities.

Energy generation and power conversion represent engineering tasks for requirements definition and design optimization, and thus provide a practical solution to magnetic-induced acceleration and launch of projectiles. The combination of: (a) the Halbach array 155 in the armature 150 for traveling with the projectile 160, (b) the multi-phase tubular LSM drive along the launch conduit 110, and optionally (c) the concentric elements 140 of the induction track along the launch conduit 110 into a viable concept, represents new technology.

The LSM driven launcher or gun may provide several advantages over propelled missiles and the rail gun. The LSM technology is substantially mature for rapid prototyping development. The desired acceleration forces are feasible for designs employing the concepts described herein. Additionally, the bucket may be reusable.

In contrast to missiles, the inventive embodiments described herein require no chemically energetic propellant. The energy consumption curve may be more readily achievable, being only $10^3$ amps compared $10^6$ amps for conventional rail gun designs in select applications. Additionally, the system efficiency can be on the order of ninety percent.

An effective EM launcher could be used to replace the current 5-inch caliber ship-board gun used by the United States Navy. Such a launcher could also be employed for land-based fire support, missile defense, anti-satellite weaponry, air defense, micro-satellite launch, nuclear waste disposal, etc. By eliminating surface contact between the projectile and the launch tube using magnetic induced and inherent levitation, frictional wear may be minimized. Consequently, the energy costs for a launch may be below $5 per kilogram.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. An electromagnetic (EM) launcher for ejecting a projectile and receiving electrical power from an alternating current source, the launcher comprising:

an armature for holding the projectile, wherein the armature includes a Halbach array; and a launch conduit for accelerating the armature along a longitudinal direction and thereby ejecting the projectile, the conduit comprising:

a plurality of permanent magnets distributed longitudinally along the conduit; and a multi-phase linear synchronous motor (LSM) drive.

2. The launcher according to claim 1, wherein the armature and the conduit form concentric and radially successive tubular cross-sections.

3. The launcher according to claim 1, wherein the Halbach array includes a plurality of magnets disposed longitudinally along the armature, each magnet forming a concentric ring and having a magnetic field oriented perpendicular to at least one adjacent magnet, north direction of the magnetic field pointing at one of radially inward, radially outward, longitudinally inward and longitudinally outward.

4. The launcher according to claim 1, wherein the Halbach array includes a plurality of magnets disposed longitudinally along the armature, each magnet forming a concentric ring and having a magnetic field oriented at least one of collinear with a first adjacent magnet and perpendicular to a second adjacent magnet, north direction of the magnetic field pointing at one of radially inward, radially outward, longitudinally inward and longitudinally outward.

5. The launcher according to claim 1, wherein the LSM drive includes a wire for each phase, the wire concentric wrapping around the conduit along the longitudinal direction at specific magnetic pole intervals corresponding to each phase.

6. The launcher according to claim 1, wherein the LSM drive incorporates at least three phases of sinusoidally fluctuating electric current.

7. A method for ejecting a projectile using electromagnetic forces, the method comprising:

holding the projectile by an armature;

providing a Halbach array for the armature;

inserting the armature in a launch conduit having a longitudinal direction;

providing a multi-phase linear synchronous motor (LSM) drive for the launch conduit;

providing a plurality of short conducting elements distributed longitudinally along the conduit in cooperation with the LSM drive; and accelerating the armature along the longitudinal direction by supplying alternating electric current through the multi-phase LSM drive.

8. The method according to claim 7, wherein providing the Halbach array includes:

disposing a plurality of magnets longitudinally along the armature;

forming each magnet into a concentric ring, each magnet having a magnetic field oriented one of:

perpendicular to at least one adjacent magnet, and at least one of collinear with a first adjacent magnet and perpendicular to a second adjacent magnet; and pointing north direction of the magnetic field at one of radially inward, radially outward, longitudinally inward and longitudinally outward.

* * * * *